US005104282A

United States Patent [19]

Gleason

[11] Patent Number: 5,104,282

[45] Date of Patent: Apr. 14, 1992

[54] DOCUMENT FEEDER

[75] Inventor: Michael E. Gleason, Allentown, Pa.

[73] Assignee: Bell & Howell Phillipsburg Co., Allentown, Pa.

[21] Appl. No.: 667,267

[22] Filed: Mar. 11, 1991

[51] Int. Cl.[5] ..... B65G 57/00

[52] U.S. Cl. ..... 414/790.3; 271/315; 271/308; 271/186; 271/187

[58] Field of Search ..... 271/70, 72, 83, 187, 271/307, 308, 315, 220, 186; 414/790.3

[56] References Cited

U.S. PATENT DOCUMENTS

| | | | |
|---|---|---|---|
| 3,490,761 | 1/1970 | Bell | 270/58 |
| 3,912,255 | 10/1975 | McInerny | 271/187 X |
| 3,944,209 | 3/1976 | Fallos | 271/4 |
| 3,944,213 | 3/1976 | Fallos | 271/10 |
| 3,944,214 | 3/1976 | Fallos | 271/10 |
| 4,357,126 | 11/1982 | Kidd et al. | 414/790.3 |
| 4,431,178 | 2/1984 | Kokubo et al. | 271/187 |
| 4,760,923 | 8/1988 | Lundblad et al. | 414/790.3 X |
| 4,828,243 | 5/1989 | Ebihara | 271/187 X |
| 4,861,019 | 8/1989 | Michalik | 271/307 X |

FOREIGN PATENT DOCUMENTS

| | | | |
|---|---|---|---|
| 0312749 | 4/1989 | European Pat. Off. | 271/187 |
| 0033059 | 2/1990 | Japan | 414/790.3 |
| 0753345 | 7/1956 | United Kingdom | 414/790.3 |

*Primary Examiner*—H. Grant Skaggs
*Assistant Examiner*—Carol Lynn Druzbick
*Attorney, Agent, or Firm*—Griffin, Branigan & Butler

[57] ABSTRACT

An improved document feeder for feeding a predetermined number of singulated checks in seriatim for accumulation into a check stack package, for delivering the package to further handling device, and for realigning the checks therein while the package is being delivered. The feeder comprises a singulator; a feeder section that feeds the singulated checks via a spider wheel to an accumulator bin for accumulation into a check stack package; and reciprocating kicker arms for realigning the accumulated check stack package and for delivering the check stack package to further handling devices. The reciprocating kicker arms the accumulated check stack package by engaging trailing edges of the checks in the check stack package and kicking the package into engagement between driven nip wheels. The kicker arms and the driven nip wheels deliver the check stack package.

18 Claims, 1 Drawing Sheet

DOCUMENT FEEDER

BACKGROUND

1. Field of the Invention

This invention relates generally to document feeders and more particularly to a high-speed check feeder that singulates and feeds checks from a supply stack of checks; accumulates a predetermined number of the singulated checks in a check-stack package; and, realigns and delivers the check stack package to further handling means.

2. Prior Art and Other Considerations

Various document feeders are known and have been employed for feeding and processing documents such as bank checks. In particular, such feeders are used for mailing bank statements including checks. Bell U.S. Pat. No. 3,490,761, for example, discloses a bank-statement processing machine.

In general, the processing of checks requires particular reliability in view of the strict need to preserve confidentiality. For example, checks destined for a specific customer should not be included by mistake in mailings to another customer, and all checks belonging to a bank statement should accompany the respective statement in the proper mail package. In view of the continually increasing need for handling and processing higher quantities of documents at high speeds and high throughput rates, reliability and speed requirements are becoming more and more stringent while the market simultaneously demands constantly increasing throughput rates.

Prior art document feeding equipment, particularly for the feeding of checks, has consistently suffered from problems caused by the checks' low mass, flimsiness, size differences, differences in paper properties, and the like. Varying friction, windage and electrostatic effects, and similar effects arising during processing have been a source of difficulties that have been encountered particularly in the handling and processing of checks at higher speeds. Such problems and difficulties have resulted in misalignment of checks relative to one another and in relation to machine structures during the processing of checks. Consequent machine malfunction, jamming, or incorrect processing has plagued the art of document feeding—particularly high-speed check feeding.

The task for check feeding equipment employed in conjunction with the preparation and mailing of checks in association with a corresponding bank statement is essentially to singulate and feed a predetermined number of checks from a supply stack. The checks are then accumulated into an appropriate check package for insertion into a mailing envelope together with the associated bank statement (and sometimes also with other documents). The aforementioned problems and difficulties occur primarily during feeding of the singulated checks and during their accumulation into a check package. Thus, the misalignment of checks (skewing, lagging, and the like) can result in checks being ineffectively accumulated in a package. Further handling of such a flawed or faulty package, for example in attempts to insert the package into an envelope, can be very troublesome.

Document feeders of a kind suited to the foregoing task currently feed up to about forty checks per second, albeit not always at adequate reliabilities.

The document feeder of the present invention reduces and avoids difficulties and problems of the aforementioned kind by restraining singulated checks from significant misalignment as they are being fed for accumulation and, by realigning the accumulated check package while it is being delivered to further handling means. The document feeder of the invention can operate at throughput rates of up to about 75 to 80 checks per second (or more), at an adequate reliability that at least equals or significantly exceeds the operational reliability of conventional feeders.

Accordingly, an important overall feature of the invention is the provision of an improved document feeder and an improved method of feeding documents or checks reliably at high processing speeds, wherein the feeder singulates and feeds singulated checks for accumulation into a check package that is realigned while it is being delivered to further handling means.

SUMMARY

In accordance with principles of the present invention, an improved document feeder is provided for feeding a predetermined number of singulated checks for accumulation into a check stack package and for realigning the package while it is being delivered to further handling means.

The document feeder comprises a singulator that singulates a predetermined number of checks from a stack of checks; a feeder section that feeds the singulated checks via a spider wheel to an accumulator bin for accumulation into a check-stack package; means for realigning the accumulated check stack package; and, means for delivering the check stack package to further handling means. The singulator can be any appropriate singulating apparatus capable of singulating checks and delivering the checks in seriatim to the feeder section at suitably high rates.

The feeder section captures the checks in a nip between rollers, at least one of which is driven. A check is driven through the nip into a gap region between arms of one or more driven spider wheels (generally tangentially thereto) in an upper region of the wheels, where the arms have a trailing orientation with respect to the direction of rotation of the wheels. Each check is carried along the peripheries of the wheels (between arms) from the upper region to a lower region thereof where the check is stripped from the wheels by stripper means. The check is thereby deposited into an accumulator bin, and subsequently arriving checks are deposited on top of previously deposited checks so that a check-stack package is accumulated in the accumulator bin.

A curtain of at least two downwardly suspended resilient strips can be disposed along the front peripheries of the spider wheels. The strips are generally tangentially disposed in relation to the periphery of the spider wheels and serve to avoid check flutter and similar effects as checks are being conveyed by the spider wheels. Further, a housing closely surrounding at least portions of the peripheries of the spider wheels can be provided to assure that checks do not slip out of the spider wheels while being conveyed thereby.

Means for realigning and delivering the accumulated check stack package include at least one reciprocating kicker arm for engaging trailing edges of the checks in the accumulated stack package (thereby realigning the checks with their trailing edges against the engaging surfaces of the kicker arms) and kicking the check stack package along a delivery surface. The delivering means further includes a set of nip wheels that capture the kicked check package in the nip therebetween and drive it to further handling means.

In operation, a predetermined number of checks is singulated and in seriatim fed from a stack of checks via the spider wheels. The spider wheels deposit the checks on top of one another in the form of a check-stack package in the accumulator bin. Once accumulated, the check-stack package is realigned by reciprocating kicker arms that engage the trailing edges of the checks in the package. The kicker arms then deliver the check package by kicking it along a delivery surface to and between driven nip wheels so that the package is delivered to further handling means by the action of the driven nip wheels. Further handling means generally includes mail-inserter machinery or similar equipment.

BRIEF DESCRIPTION OF THE DRAWINGS

The foregoing and other objects, features and advantages of the invention will be apparent from the following more particular description of preferred embodiments of the invention, as illustrated in the accompanying drawing. The drawing is schematic and not necessarily to scale, emphasis instead being placed upon illustrating principles of the invention.

DESCRIPTION OF THE PREFERRED EMBODIMENTS

Figure 1:
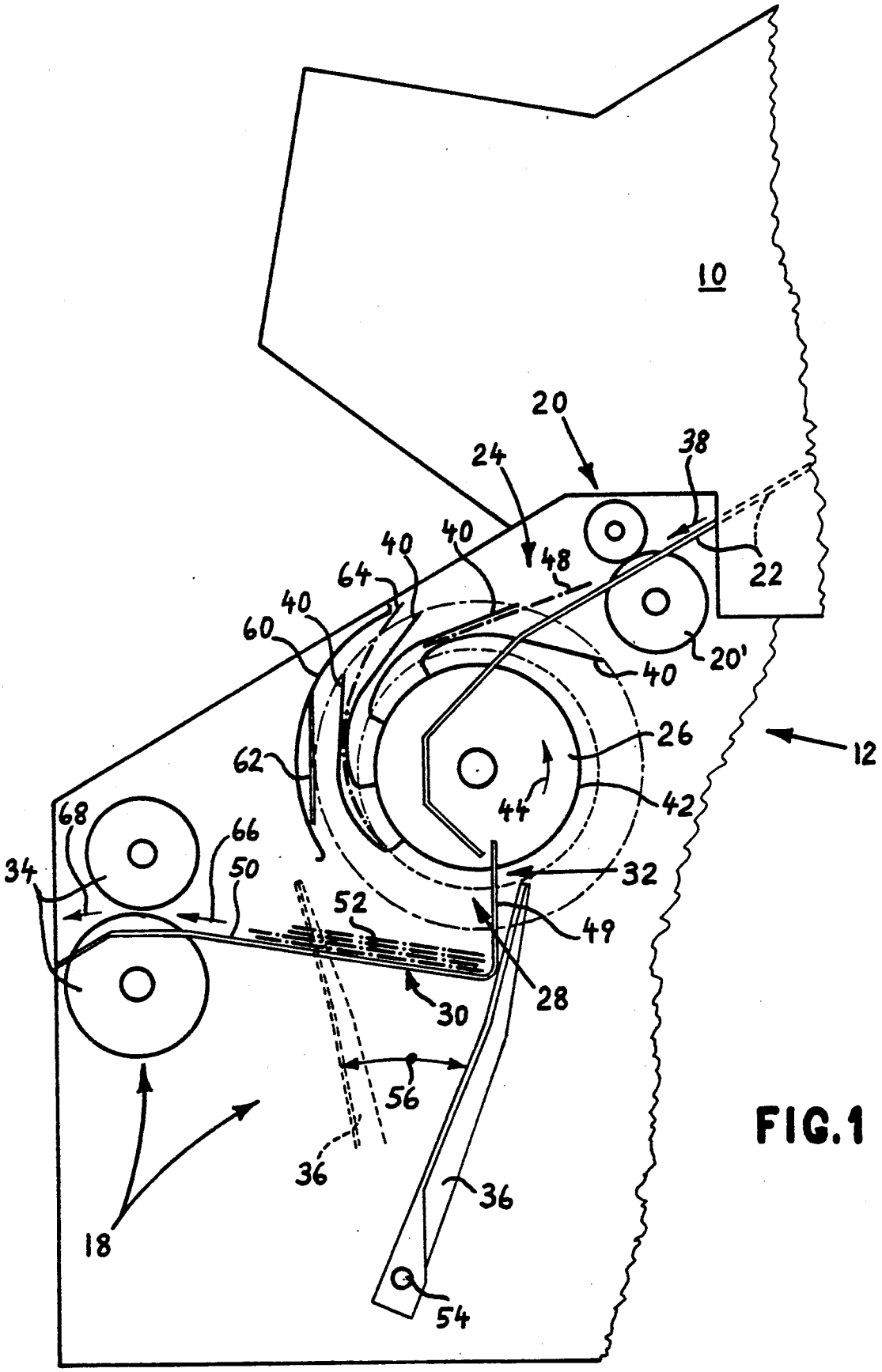
FIG. 1 is a schematic side elevational view of a document feeder according to the invention.

Referring now to the drawing of FIG. 1, there is shown an embodiment of the document feeder of the present invention comprising a singulator 10, a feeder section 12, and realigning and delivering means 18.

Singulator 10 is of a conventional kind customarily employed for singulating predetermined numbers of documents from a document stack and feeding or delivering the documents in seriatim to further equipment—here to the feeder section 12 of the document feeder.

The feeder section 12 comprises a set of nip rollers 20 including a driven roller 20', supporting means 22 upon and along which documents are fed from the singulator 10 into the feeder section 12, and a receiving region 24 for receiving singulated documents from nip rollers 20. The feeder section further comprises one or more driven spider wheels 26, a stripping region 28, an accumulator bin 30, and stripping and depositing means 32 for the stripping of the documents from spider wheels 26 in stripping region 28 and for depositing the documents on accumulator bin 30.

Realigning and delivering means 18 comprise a set of driven nip wheels 34 and one or more reciprocating kicker arms 36.

Nip rollers 20 are disposed at the entry to feeder section 12. Rollers 20 form a nip located vicinally to and above supporting means 22. Rollers 20 are employed for the receiving and feeding of singulated documents fed thereto from singulator 10 in the direction of arrow 38 and for feeding documents further to the spider wheels 26 at receiving region 24. Spider wheels 26 (only one of which is shown) include a plurality of arms 40 that extend outwardly from a hub periphery 42 of wheel 26. Arms 40 are curved and oriented trailingly in relation to the rotation of the driven spider wheels in the direction of arrow 44. Formed between arms 40 are gap regions into which documents are fed by nip rollers 20. A thusly fed document 48 is shown (by a phantom line) in a gap region between two arms 40 positioned in receiving region 24.

Stripping and depositing means 32 includes a barrier wall 49 that is substantially vertically oriented and that is disposed at stripping region 28 above and at one end of accumulator bin 30.

Accumulator bin 30 includes a delivery surface 50 upon which documents are deposited. An example of deposited documents in the form of a stack package 52 is illustrated by phantom lines.

Driven nip wheels 34 are disposed at the exit from accumulator bin 30 so that the nip therebetween is located vicinally to and above delivery surface 50. Reciprocating kicker arm 36 (or lever arm) is rotatable or swingable about an axle 54 along an arc 56 between a first orientation shown in solid lines and a second orientation indicated by dashed lines.

Further included in the feeder section 12 is a housing 60 that surrounds a portion of the periphery of spider wheel 26 in a region between receiving region 24 and stripping region 28. The inner surface of housing 60 has a smooth surface of generally arcuate shape substantially radially spaced from the free peripheral tips of arms 40 (of spider wheel 26). The inner surface of housing 60 is operative in preventing documents from slipping out of the gap regions between arms 40 during the conveying of documents by spider wheels 26.

Also included in the feeder section 12 is a stationary curtain having at least two substantially downwardly suspended resilient strips 62 disposed in close proximity to the free peripheral tips of arms 40 in a region between receiving region 24 and stripping region 28. Strips 62 are operative in damping flutter of documents by contacting the documents and resiliently restraining them from fluttering while the documents are conveyed in spider wheels 26.

Driven roller 20' has a diameter that is preferably in the range of about one and one quarter to one and three eighths inches. Spider wheels 26 have an outer diameter of the tip periphery of arms 40 that is preferably in the range of about three and three quarters to four and one quarter inches. A preferred ratio between the rotational speeds of driven roller 20' and driven spider wheel 26 is in the range of about 14–16. A preferred rotational speed for driven roller 20' is about 3500 RPM. A preferred rotational speed for driven spider wheel 26 is about 250 RPM.

It is customary in the art of feeding materials of different or varying thicknesses through a nip between two wheels that one of the wheels is usually the driven wheel which revolves about a fixed axis and the other one is freely rotatable. The axis of the latter is usually resiliently spring-loaded toward the driven wheel to accommodate different material thicknesses. Accordingly, the lower wheel of the nip wheels 34 is driven to revolve about a fixed axis, whereas the upper wheel is preferably borne upon a shaft which is carried in a swing-arm arrangement that spring loads the upper wheel toward the lower wheel. Varying thicknesses of stack-packages of documents can be thereby accommodated in the nip between the wheels 34.

It should be understood that different components of the embodiments illustrated here in side view are not necessarily disposed in the same plane. As is customary in the art of sheet material or document handling, more than one of identical components such as rollers, wheels, levers, and the like are often provided in different transversely spaced relationships to one another to appropriately support and feed documents having a substantial transverse extent. For instance, two or more sets of nip rollers 20 that are transversely spaced from one another would normally be provided. Similarly, two or more spider wheels that are transversely spaced from one another would normally be provided. Particularly in the case of small documents such as garment tags, for example, only a single spider wheel might be adequate. The same considerations can apply to the nip wheels 34, the kicker arm 36, the barrier wall 49 of stripping means 32, the housing 60, the curtain strips 62, etc. Moreover, in order to provide suitable operational clearances for movable components, appropriate transverse gaps are provided between other components.

In this respect, supporting means 22, for example, can be provided in form of a plate that is perforated along its transverse direction by clearance openings to clear nip rollers 20' and spider wheels 26. Similarly, the delivery surface 50 will be provided with appropriate clearance cut-outs to clear the lower wheels of nip wheels 34. Also, the barrier wall 49 of stripping and depositing means 32 should be understood to have appropriate cut-outs to clear the spider wheel or wheels 26 and to provide a clearance opening for the reciprocating motion of the kicker arm or arms 36.

In the latter respect, kicker arms 36 are disposed transversely such as not to interfere with spider wheels 26. Furthermore, the accumulator bin 30 has suitable cut-outs or slots to allow clearance for the reciprocating motion of kicker arms 36. It will be understood that alternate, equally practical design measures can be applied. For instance, components such as supporting means 22, barrier wall 49, delivery surface 50, and accumulator bin 30 can each be formed from a number of substantially identical separate structures having a relatively narrow transverse extent and being transversely spaced from one another such as to provide clearances for other components which are disposed in or need to move through the transverse plane of these components; such other components being, for instance, nip rollers and wheels, kicker arms, spider wheels, and the like.

In operation of the document feeder, singulator 10 singulates a predetermined number of documents from a stack of documents and feeds the singulated documents in seriatim along supporting means 22 in the direction of arrow 38 into the nip between nip rollers 20. Nip rollers 20 engage and further feed (through their nip) the documents at receiving region 24 into gap regions between arms 40 of spider wheels 26. The latter is indicated in the illustration by document 48. The spider wheels are driven to revolve in the direction of arrow 44 and thereby convey inserted documents from the receiving region 24 to stripping region 28. This conveying is indicated in the illustration by a document 64. Barrier wall 49 of stripping and depositing means 32 in stripping region 28 strips documents being conveyed thereto from spider wheel 26 and deposits the stripped documents one on top of another upon delivery surface 50 in accumulator bin 30 in the form of a stack package of a predetermined number of documents. The latter is indicated in the illustration by stack package 52.

The stack package is further realigned and delivered via driven nip wheels 34 to further handling means. In particular, the stack package is engaged and realigned at the trailing edges of the documents by kicker arm 36, as the kicker arm is moved in a counterclockwise direction. The stack package is kicked by kicker arms 36 along delivery surface 50 in the direction of arrow 66 to the nip between nip wheels 34. The kicked stack package is received between nip wheels 34 and is thereby driven and delivered in the direction of arrow 68 to the further handling means. The kicker arms 36 are intermittently driven to reciprocatingly swing about axle 54. As documents are accumulated in accumulator bin 30, kicker arms 36 are stationary in the first orientation shown by solid lines. Once the predetermined number of documents is accumulated, kicker arms 36 are swung from this first orientation counterclockwise to a second orientation indicated by dashed lines. Thereafter, kicker arms 36 are returned in the opposite direction of rotation to the first orientation in readiness for the accumulation of the next stack package.

While the invention has been particularly shown and described with reference to preferred embodiments thereof, it will be understood by those skilled in the art that various changes and modifications in form and details may be made therein without departing from the spirit and scope of the invention.

The embodiments of the invention in which an exclusive property or privilege is claimed are defined as follows:

1. A document feeder comprising:

a singulator for feeding seriatim a predetermined number of singulated documents from a document stack;

a feeder section for further feeding the singulated documents fed thereto from said singulator, said feeder section including:

a set of nip rollers for receiving and feeding the singulated documents, said set of nip rollers including at least one driven roller, a receiving region for receiving singulated documents from said nip rollers, a stripping region, a driven spider wheel having arms disposed along the periphery thereof and having gap regions between said arms, said arms being oriented trailingly with respect to the direction of rotation of said spider wheel, said gap regions receiving the singulated documents in said receiving region from said nip rollers, said spider wheel conveying the singulated documents from said receiving region to said stripping region, an accumulator bin having a delivery surface; and, means for stripping the singulated documents from said gap regions in said stripping region and depositing the stripped singulated documents one upon another in said accumulator bin so as to form a stack package of the predetermined number of documents; and, means for realigning and delivering of the stack package of the predetermined number of documents deposited and accumulated in said accumulator bin, said means for realigning and delivering including:

take-away means; and, a reciprocatingly movable kicker arm for engaging and thereby realigning trailing edges of the documents in the stack package and for kicking the stack package along said delivery surface to said take-away means, said reciprocatingly movable kicker arm including a lever arm that is reciprocatingly swingable about an axle, said lever arm being intermittently movable to swing along an arc in one direction from a first orientation to a second orientation and return in the opposite direction to the first orientation;

whereby said take-away means receives the kicked stack package.

2. The document feeder according to claim 1, wherein said feeder section includes a housing surrounding a portion of the periphery of said spider wheel in a region between said receiving and stripping regions, said housing having an inner surface of generally arcuate shape radially spaced from the peripheral tips of said arms of said spider wheel.

3. The document feeder according to claim 1, wherein said feeder section includes a curtain having at least two substantially downwardly suspended strips disposed in a region between said receiving and stripping regions in close proximity to the peripheral tips of said arms.

4. The document feeder according to claim 1, wherein said driven roller has an outer diameter in the range of about one and one quarter to one and three eighths inches, and wherein said spider wheel has an outer diameter of the tip periphery of said arms in the range of about three and three quarters to four and one quarter inches.

5. The document feeder of claim 4, wherein the ratio between the rotational speeds of said driven roller and said driven spider wheel is in the range of about 14–16.

6. The document feeder of claim 4, wherein the rotational speeds of said driven roller and of said driven spider wheel are about 3500 RPM and 250 RPM, respectively.

7. The document feeder according to claim 1, wherein said means for stripping include a stripper barrier laterally disposed with respect to said spider wheel in said stripping region so as to engage leading edges of documents conveyed in said spider wheel and thereby stop and release the documents from said gap regions, whereby the stripped documents are deposited in said accumulator bin.

8. The feeder of claim 1 wherein said take-away means comprises a pair of nip rolls.

9. A method of feeding documents, comprising the steps of:

singulating a plurality of documents from a stack of documents;

driving a spider wheel having gap regions between arms thereof, said arms being trailingly oriented with respect to the direction of rotation of said spider wheel;

feeding said singulated documents in seriatim into said gap regions;

conveying said documents in said gap regions from said receiving region to a stripping region;

stripping said documents from said gap regions at said stripping region;

depositing stripped documents one upon another in form of a stack package of documents upon a delivery surface in an accumulator bin; and, realigning and delivering the stack package, the step of realigning and delivering including steps of:

engaging the stack package at trailing edges of the documents and thereby realigning the trailing edges, kicking the stack package along said delivery surface into a take-away means, wherein the steps of engaging and kicking include a step of reciprocatingly swinging a kicker arm about an axle along an arc from a first to a second orientation in one direction and a step of returning said kicker arm in the opposite direction to said first orientation; and, removing the kicked stack package by said take-away means.

10. The method according to claim 9, wherein the step of conveying includes the steps of:

providing a stationary housing surrounding a portion of the periphery of said spider wheel in a region between said receiving and stripping regions, said housing having an inner surface of generally arcuate shape substantially spaced from the periphery of said spider wheel and from the free peripheral tips of said arms thereof; and, restraining documents from moving out of said gap regions by means of said housing.

11. The method according to claim 9, wherein the step of conveying includes the steps of:

providing a stationary curtain having at least two substantially downwardly suspended strips, said strips being disposed in a region between said receiving and stripping regions in close proximity to the free peripheral tips of said arms; and, contacting said documents and restraining the documents from fluttering.

12. The method according to claim 9 including the steps of:

using a set of nip rollers to deliver said documents to said gap regions, at least one of said nip rollers being a driven roll;

providing said driven nip roller with an outer diameter in the range of about one and one quarter to one and three eighths inches;

providing said spider wheel with an outer diameter of the tip periphery of said arms in the range of about three and three quarters to four and one quarter inches; and driving the driven nip roller and said spider wheel at a ratio of rotational speeds between said driven nip roller and said spider wheel in the range of about 14–16.

13. The method of claim 12, wherein the steps of driving the driven nip roller and said spider wheel are effected at rotational speeds of about 3500 and 250 RPM, respectively.

14. The method of claim 9, wherein the steps of engaging and kicking are effected during the step of reciprocatingly swinging said kicker arm from said first orientation to said second orientation.

15. The method of claim 9 wherein the step of removing the kicked stack package is accomplished by means of nip rolls.

16. The method of claim 9 wherein the step of feeding said documents into said gap region is accomplished by means of nip rolls.

17. A document feeder comprising:

a singulator for feeding seriatim a predetermined number of singulated documents from a document stack;

a feeder section for further feeding the singulated documents fed thereto from said singulator, said feeder section including:

a set of nip rollers for receiving and feeding the singulated documents, said set of nip rollers including at least one driven roller, a receiving region for receiving singulated documents from said nip rollers, a stripping region, a driven spider wheel having arms disposed along the periphery thereof and having gap regions between said arms, said arms being oriented trailingly with respect to the direction of rotation of said spider wheel, said gap regions receiving the singulated documents in said receiving region from said nip rollers, said spider wheel conveying the singulated documents from said receiving region to said stripping region, an accumulator bin having a delivery surface; and, means for stripping the singulated documents from said gap regions in said stripping region and depositing the stripped singulated documents one upon another in said accumulator bin so as to form a stack package of the predetermined number of documents, wherein said feeder section includes a curtain having at least two substantially downwardly suspended strips disposed in a region between said receiving and stripping regions in close proximity to the peripheral tips of said arms; and, means for realigning and delivering of the stack package of the predetermined number of documents deposited and accumulated in said accumulator bin, said means for realigning and delivering including:

take-away means; and, a reciprocatingly movable kicker arm for engaging and thereby realigning trailing edges of the documents in the stack package and for kicking the stack package along said delivery surface to said take-away means;

whereby said take-away means receives the kicked stack package.

18. A method of feeding documents, comprising the steps of:

singulating a plurality of documents from a stack of documents;

driving a spider wheel having gap regions between arms thereof, said arms being trailingly oriented with respect to the direction of rotation of said spider wheel;

feeding said singulated documents in seriatim into said gap regions;

conveying said documents in said gap regions from said receiving region to a stripping region, wherein the step of conveying includes the steps of:

providing a stationary curtain having at least two substantially downwardly suspended strips, said strips being disposed in a region between said receiving and stripping regions in close proximity to the free peripheral tips of said arms, and, contacting said documents and restraining the documents from fluttering;

stripping said documents from said gap regions at said stripping region;

depositing stripped documents one upon another in form of a stack package of documents upon a delivery surface in an accumulator bin; and, realigning and delivering the stack package, the step of realigning and delivering including steps of:

engaging the stack package at trailing edges of the documents and thereby realigning the trailing edges, kicking the stack package along said delivery surface into a take-away means; and, removing the kicked stack package by said take-away means.

* * * * *